US005391455A

United States Patent [19]

Bigelow

[11] Patent Number: 5,391,455

[45] Date of Patent: Feb. 21, 1995

[54] PICK-OFF ROLL FOR DAD DEVELOPMENT TO PRESERVE DEVELOPER CONDUCTIVITY AND REDUCE PHOTORECEPTOR FILMING

[75] Inventor: Richard W. Bigelow, Webster, N.Y.

[73] Assignee: Xerox Corporation, Stamford, Conn.

[21] Appl. No.: 155,494

[22] Filed: Nov. 22, 1993

[51] Int. Cl.[6] ..... G03G 13/22; G03G 15/22

[52] U.S. Cl. ..... 430/120; 430/42; 355/245; 355/259; 118/653

[58] Field of Search ..... 430/42, 120; 355/245, 355/259; 118/653

[56] References Cited

U.S. PATENT DOCUMENTS

| | | | |
|---|---|---|---|
| 4,078,929 | 3/1978 | Gundlach | 430/42 |
| 4,494,863 | 1/1985 | Laing | 355/302 |
| 4,639,115 | 1/1987 | Lin | 355/300 |
| 4,705,387 | 11/1987 | Lin | 355/303 |
| 4,761,668 | 8/1988 | Parker et al. | 355/328 |

*Primary Examiner*—Roland Martin

[57] ABSTRACT

Additives contained in developer material used for developing latent electrostatic images on a charge retentive surface are intercepted prior to the developer material being moved into a development zone intermediate to the developer housing containing the developer material and the imaging surface. The additives removed are returned to the developer material for admixing therewith.

20 Claims, 4 Drawing Sheets

PICK-OFF ROLL FOR DAD DEVELOPMENT TO PRESERVE DEVELOPER CONDUCTIVITY AND REDUCE PHOTORECEPTOR FILMING

BACKGROUND OF THE INVENTION

This invention relates to xerographic development systems and more particularly to the minimization of additives depletion from developer material and the prevention of image surface filming.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

The invention is particularly useful in highlight color imaging such as tri-level imaging. The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught in the '929 patent, the xerographic contrast on the charge retentive surface or photoreceptor is divided into three levels, rather than two levels as is the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically −100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically −500 volts) and is referred to as $V_{white}$ or $V_w$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts).

In a tri-level imaging apparatus where the color developer is deposited on the electrostatic images using the DAD developer housing, problems of photoreceptor filming and developer conductivity failures have been experienced. This is because the developer additives provided for maintaining proper developer conductivity and developer flow can be developed on the photoreceptor in the background areas thereby causing photoreceptor filming and depletion of material in the developer which is provided for maintaining proper developer conductivity.

Accordingly, it is a primary purpose of this invention to provide a developer apparatus which minimizes the depletion of certain additives from the developer material contained in the developer apparatus.

It is a more specific purpose of this invention to intercept certain additives contained in the developer prior to developer deposition on the latent image and returning the additives to the developer supply thereby minimizing photoreceptor filming and reduction in developer conductivity.

The following patents relate to techniques for removing various undesirable materials from developer either prior to the developer material being deposited on latent electrostatic images contained on a charge retentive surface or subsequent to such deposition:

U.S. Pat. No. 4,494,863 granted to John R. Lang on Jan. 22, 1985 relates to a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and Kaolin from the brush. The rolls are electrically biased so that one of them attracts toner from the brush while the other one attracts debris. Thus,the toner can be reused without degradation of copy quality while the debris can be discarded.

U.S. Pat. No. 4,761,668 granted to Parker et al on Aug. 2, 1988 relates to an apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its inter-document and outboard areas. The dry toner or developer so attracted is subsequently removed from the imaging member at the cleaning station.

U.S. Pat. No. 4,705,387 granted to Ying-wei Lin on Nov. 7, 1987 relates to an apparatus for removing residual charged particles from a charge retentive surface characterized by a particle removal roller and a detoning roller, the former of which is adapted to remove the residual particles from the charge retentive surface and the latter of which removes the particles transferred to the particle removal roller. The detoning roller comprises an array of conductive electrodes extending about the circumference thereof such that when a multiphase power source is applied thereto a travelling electrostatic wave is generated which causes charged particles having a predetermined diameter and charge to be moved axially to the detoning roller towards one end thereof. The particles so moved represent toner devoid of paper debris. Thus they are suitable for reuse.

U.S. Pat. No. 4,639,115 granted to Ying-wei Lin on Jan. 27, 1987 relates to Apparatus for purifying toner prior to its use in developing latent electrostatic images. An electrically biased roll supported in the developer housing contiguous to at least one of the development rolls serves to attract paper debris from the toner contained in the toner carried by the developer roll. The roll is fabricated from a suitable insulating material and electrically biased in a manner suitable for attracting the paper debris contained in the toner. The roll is rotated and a scraper blade is provided for removing the debris therefrom. The debris so removed is allowed to fall into a catch tray which can be provided with an auger for moving it out of the tray to thereby increase the capacity of the system for debris removal.

BRIEF SUMMARY OF THE INVENTION

In accordance the present invention, the color developer housing of a tri-level imaging apparatus is provided with biased rolls for intercepting or removing developer additives such as zinc stearate and aerosil from developer rollers and returning the additives so removed to the developer in a developer housing for continued admixing therewith.

The biased rolls are charged to a voltage level slightly above the background voltage level on the photoconductive surface containing tri-level images. Thus, the biased rolls serve as surrogate imaging surfaces and behave in much the same manner as the actual imaging surface thereby selectively attracting the offending additives thereto. The additives are then scraped from the biased rolls and returned to the developer material in the developer housing. By returning the additives to the developer material, the conductivity of the developer material is maintained at an operable level.

Other features of the present invention will become apparent as the following description proceeds and upon reference to the drawings, in which:

BRIEF DESCRIPTION OF THE DRAWINGS

FIG. 1 b is a plot of photoreceptor potential illustrating single-pass, highlight color latent image characteristics.

While the present invention will be described in connection with tri-level printing, it will be understood that it is not intended to limit the invention to that type of printing. On the contrary, it is intended to cover all alternatives, modifications, and equivalents as may be included within the spirit and scope of the invention as defined by the appended claims.

DETAILED DESCRIPTION OF THE PREFERRED EMBODIMENT OF THE INVENTION

Figure 1A:
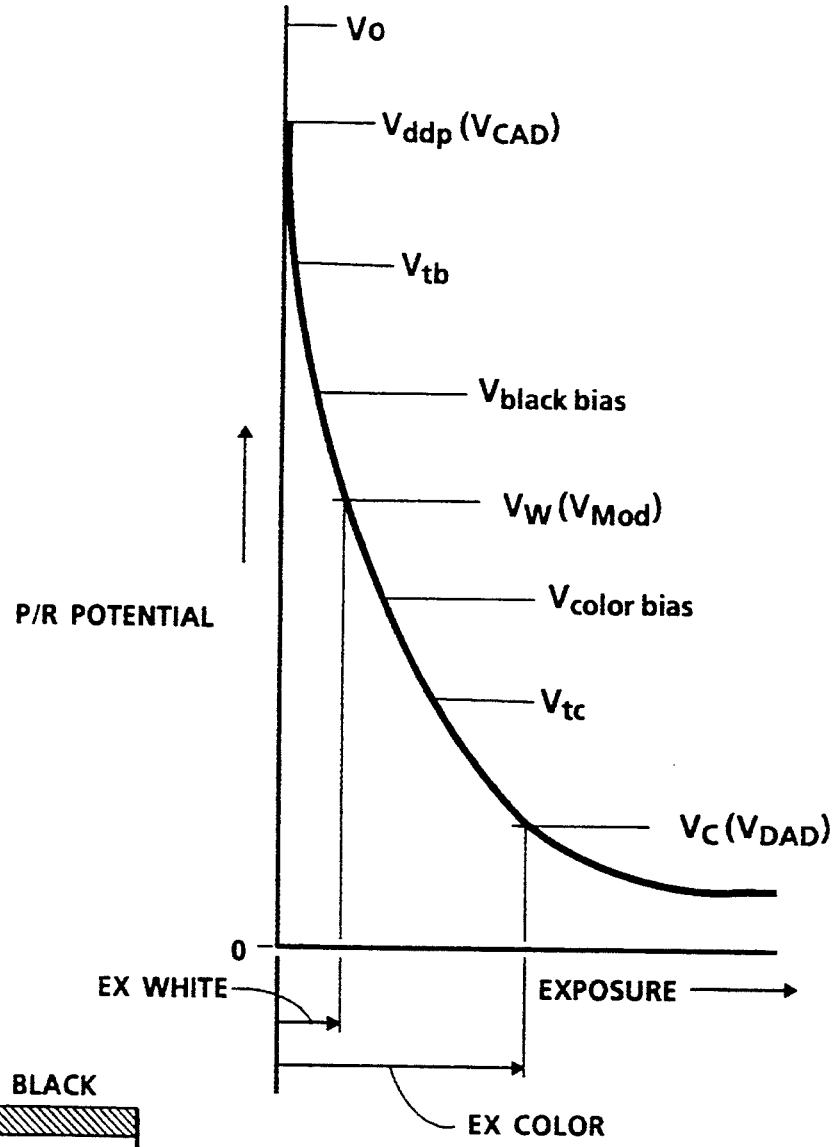
FIG. 1a PRIOR ART
FIG. 1 a is a plot of photoreceptor potential versus exposure illustrating a tri-level electrostatic latent image.
Figure 1B:
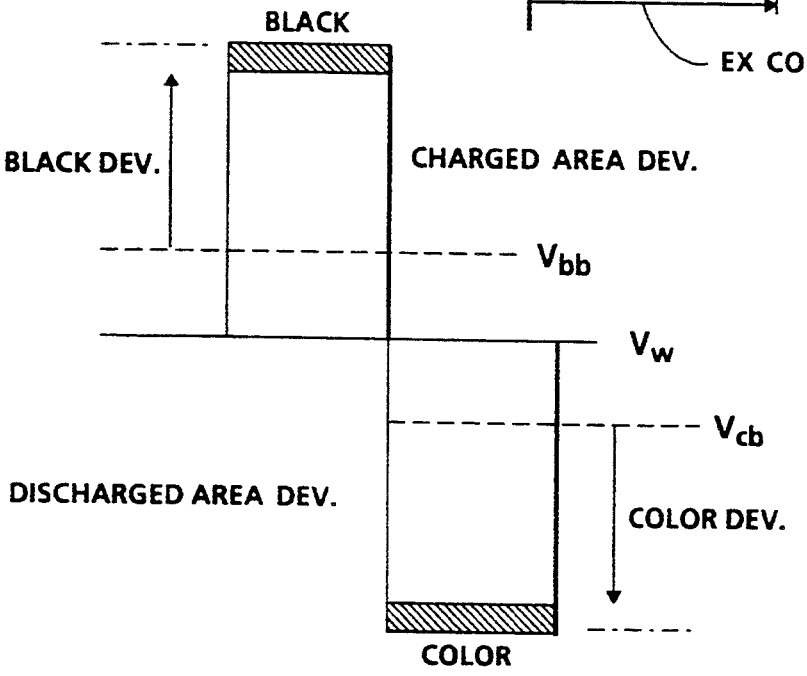
FIG. 1b PRIOR ART

For a better understanding of the concept of tri-level, highlight color imaging, a description thereof will now be made with reference to FIGS. 1*a* and 1*b*. FIG. 1*a* shows a PhotoInduced Discharge Curve (PIDC) for a tri-level electrostatic latent image according to the present invention. Here $V_0$ is the initial charge level, $V_{ddp}$ ($V_{CAD}$) the dark discharge potential (unexposed), $V_w$ ($V_{mod}$) the white or background discharge level and $V_c$ ($V_{DAD}$) the photoreceptor residual potential (full exposure using a three level Raster Output Scanner, ROS). Nominal voltage values for $V_{CAD}$, $V_{mod}$ and $V_{DAD}$ are, for example, 788, 423 and 123, respectively.

Color discrimination in the development of the electrostatic latent image is achieved when passing the photoreceptor through two developer housings in tandem or in a single pass by electrically biasing the housings to voltages which are offset from the background voltage $V_{mod}$, the direction of offset depending on the polarity or sign of toner in the housing. One housing (for the sake of illustration, the second) contains developer with black toner having triboelectric properties (positively charged) such that the toner is driven to the most highly charged $V_{ddp}$) areas of the latent image by the electrostatic field between the photoreceptor and the development rolls biased at $V_{black}$ bias ($V_{bb}$) as shown in FIG. 1*b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$). Nominal voltage levels for $V_{bb}$ and $V_{cb}$ are 641 and 294, respectively.

Figure 2:
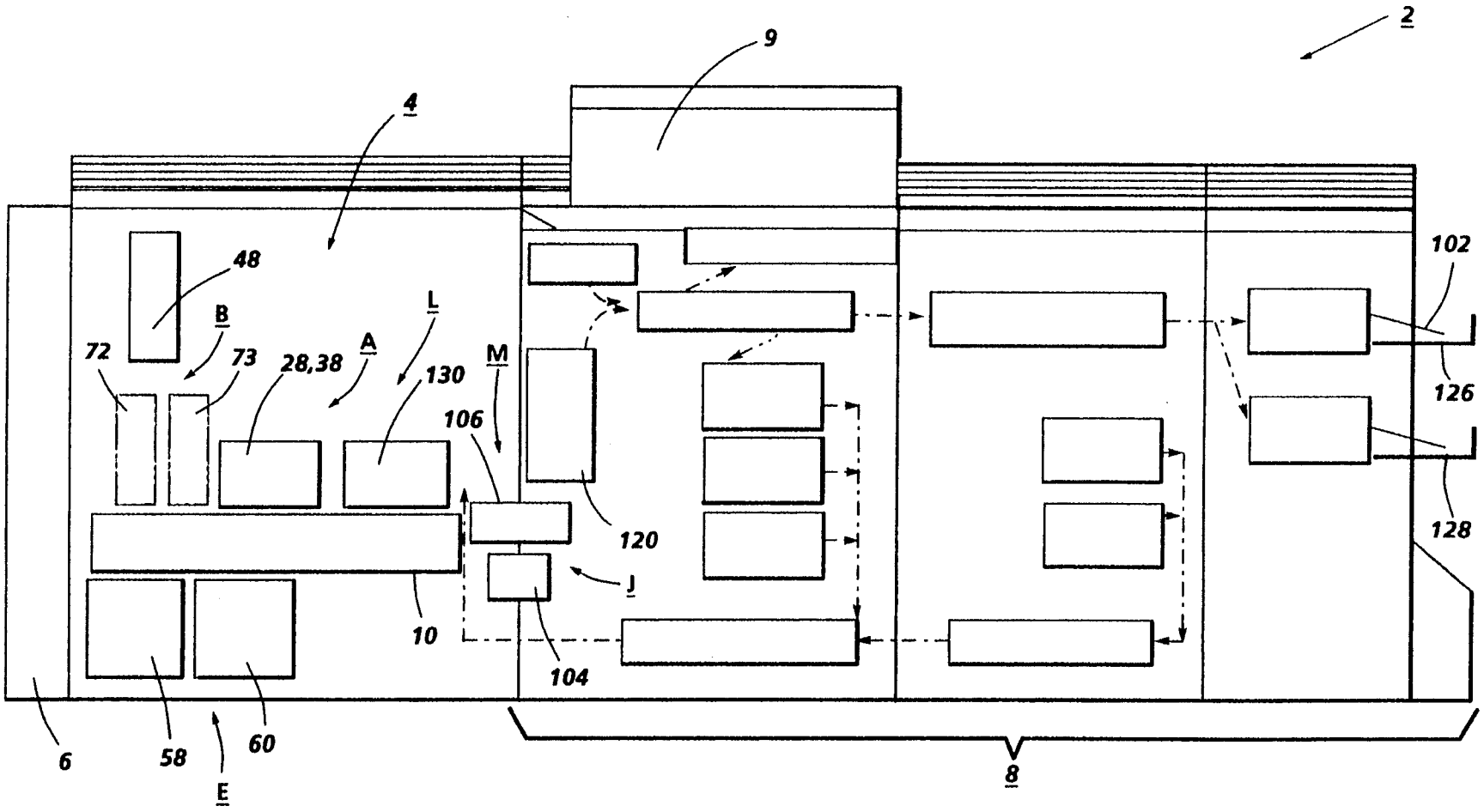
FIG. 2 is a schematic illustration of a printing apparatus incorporating the inventive features of the invention.
Figure 3:
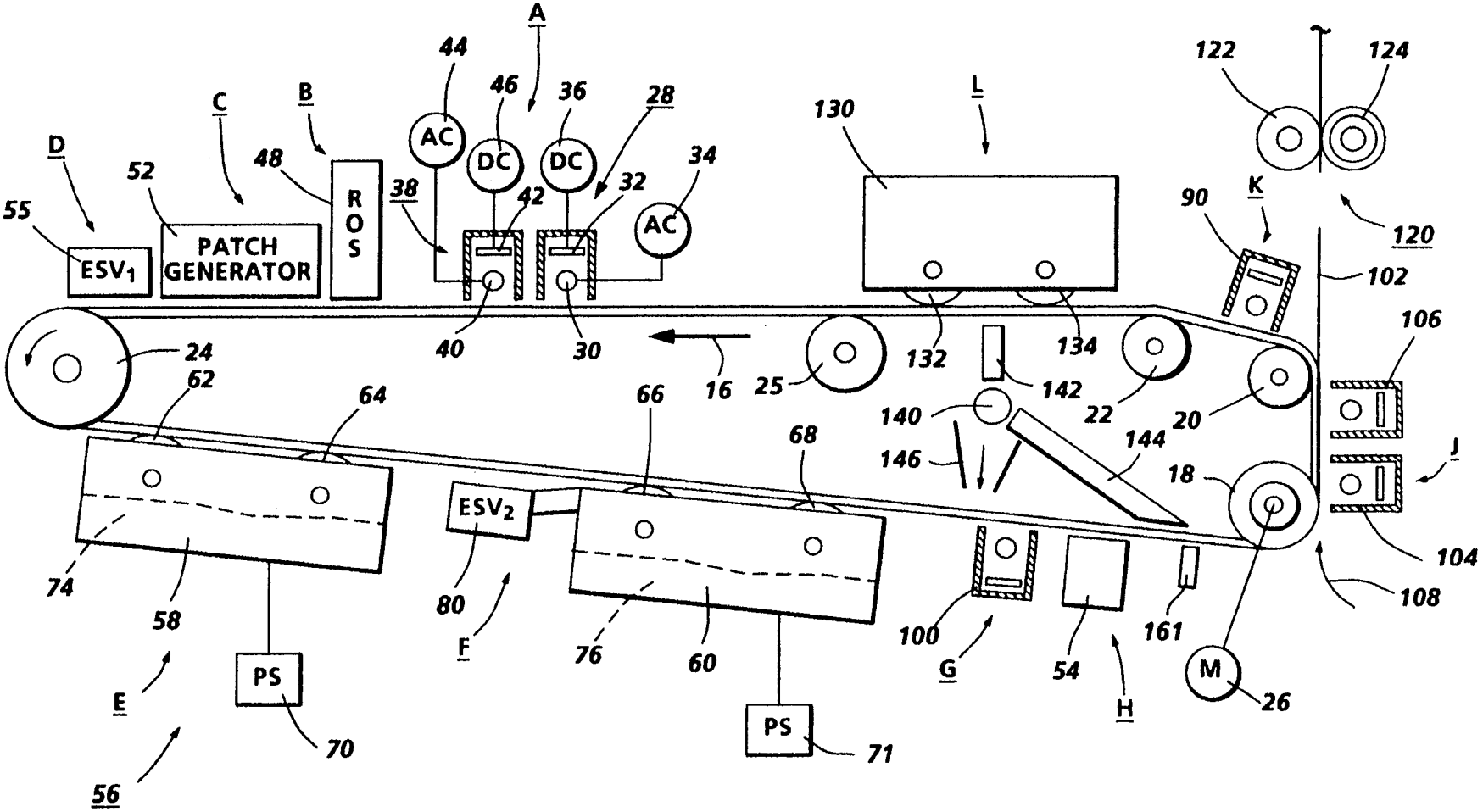
FIG. 3 is a schematic of the xerographic process stations including the active members for image formation as well as the control members operatively associated therewith of the printing apparatus illustrated in FIG. 2.

As shown in FIGS. 2 and 3, a highlight color printing apparatus 2 in which the invention may be utilized comprises a xerographic processor module 4, an electronics module 6, a paper handling module 8 and a user interface (IC) 9. A charge retentive member in the form of an Active Matrix (AMAT) photoreceptor belt 10 is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 24 and 25, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor.

As can be seen by further reference to FIGS. 2 and 3, initially successive portions of belt 10 pass through charging station A. At charging station A, a primary corona discharge device in the form of a dicorotron indicated generally by the reference numeral 28, charges the belt 10 to a selectively high uniform negative potential, $V_0$. As noted above, the initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_c$ or $V_{DAD}$ equal to about −100 volts to form a DAD image which is near zero or ground potential in the highlight color (i.e. color other than black) parts of the image. See FIG. 1*a*. The photoreceptor is also discharged to $V_w$ or $V_{mod}$ equal to approximately minus 500 volts in the background (white) areas.

A patch generator 52 (FIGS. 3 and 4) in the form of a conventional exposure device utilized for such purpose is positioned at the patch generation station C. It serves to create toner test patches in the interdocument zone which are used both in a developed and undeveloped condition for monitoring and controlling various process functions. An Infra-Red densitometer (IRD) 54 is utilized to sense or measure the voltage level of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{mod}$, and $V_{tc}$) on the P/R prior to movement of these areas of the P/R moving through the development station E.

At development station E, a magnetic brush development system, indicated generally by the reference numeral 56 advances developer materials into contact with the electrostatic latent images on the P/R. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 2) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 71. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the bias on the CAD housing is at $V_{Bias\ High}$ for a duty cycle of 90–95%. Developer bias switching between $V_{Bias\ High}$ and $V_{Bias\ Low}$ is effected automatically via the power supplies 70 and 71. For further details regarding CDC biasing, reference may be had to U.S. Pat. No. 5,080,988 granted to Germain et al on Jan.

14, 1992 and assigned to same assignee as the instant application.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 (FIG. 3) is moved into contact with the toner image at transfer station J. The sheet of support material is advanced to transfer station J by conventional sheet feeding apparatus comprising a part of the paper handling module 8. Preferably, the sheet feeding apparatus includes a feed roll contacting the uppermost sheet of a stack of copy sheets. The feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 having an outer coating or layer of silicone rubber and a deformable backup roller 124 comprising an outer layer comprising a copolymer of perfluoroalkyl perfluorovinyl ether with tetrafluroethylene (PFA). Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to catch trays 126 and 128 (FIG. 2), for subsequent removal from the printing machine by the operator.

Figure 4:
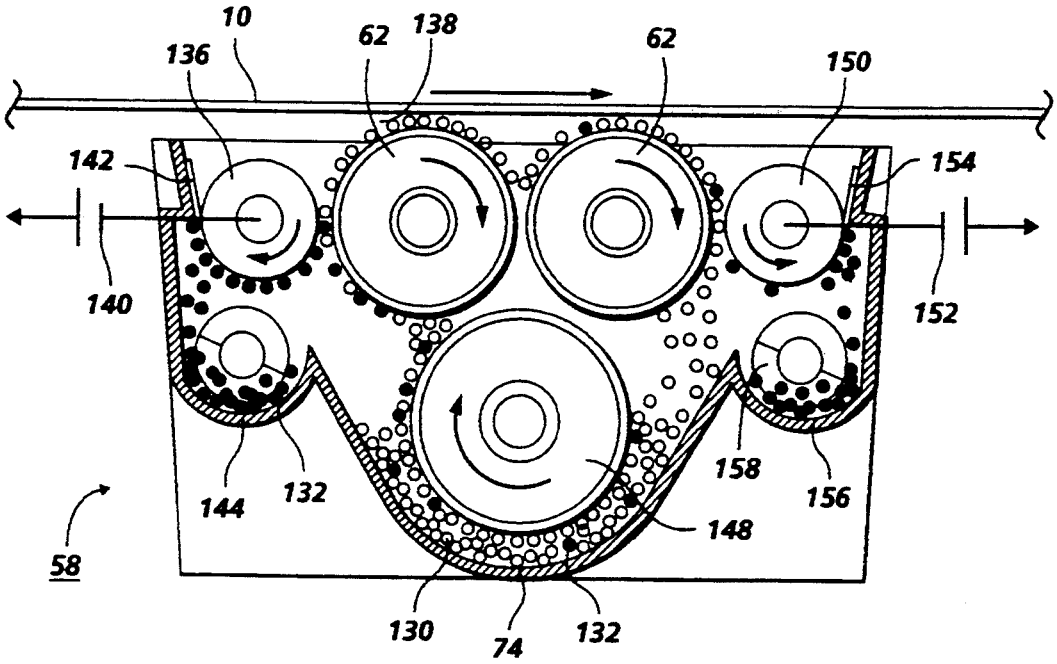
FIG. 4 is a schematic view of a developer structure according to the invention.

As illustrated in FIG. 4, the developer structure 58 comprises the supply of color developer 74 comprising color toner particles 130 and Zinc Stearate and/or aerosil agglomerates 132. A surrogate roller 136 is supported adjacent to developer roller 62 for intercepting the zinc stearate and aerosil agglomerates prior to the developer material being conveyed into a development zone 138 intermediate to the photoreceptor belt 10 and the developer rollers 62 and 64. To this end the roller 136 is electrically biased via a DC power supply 140. The roller 136 is biased to a negative potential of about 600 volts. A scraper blade 142 serves to remove the agglomerates attracted to the biased roller 136. The agglomerates fall into a sump 144 where an auger structure 146 conveys them to one end of the developer housing where they are dumped into the bottom of the developer housing to be admixed with the developer material. A paddle wheel or auger assembly 148 then conveys the developer mixture including the additives to the magnetic developer rollers 62 and 64.

A surrogate roller 150 is provided for removing agglomerates from the developer roller 64 which are not intercepted by the surrogate roller 136. A DC bias 152 serves to electrically bias the roller 150 in the same manner as the roller 136. A scraper blade 154 serves to remove the agglomerates from roller 150 so that they are free to fall into a sump 156 from where they can be returned to the bottom of the developer housing structure using an auger structure 158.

I claim:

1. A method of printing toner images, said method including the steps of:

creating latent electrostatic images on a charge retentive surface;

developing said latent electrostatic images using developer material containing additives used for enhancing developer performance but which tend to independently and/or selectively deposit on the imaging surface;

intercepting said additives prior to said toner images being developed on said imaging surface; and returning said intercepted additives back to a supply of said developer material.

2. The method according to claim 1 wherein said step of developing comprises using magnetic development rolls, a portion of which forms a development nip with said imaging surface.

3. The method according to claim 2 wherein said additives comprise zinc stearate.

4. The method according to claim 3 wherein said additives further comprise aerosil.

5. The method according to claim 2 wherein said step of intercepting comprises supporting a biased member closely adjacent to one of said magnetic development rolls for attracting said additives thereto prior to their being carried into said nip.

6. The method according to claim 5 including the step of returning said additives comprises scraping them from said biased member and permitting them to fall into said supply of developer.

7. The method according to claim 6 wherein said step of developing comprises developing tri-level images comprising charged and discharged area images and background areas intermediate to said image areas and said biased member is biased to a voltage level approximately equal to the voltage level of said background areas.

8. The method according to claim 2 including the step of removing additives to the developer material which were not removed during said intercepting step.

9. The method according to claim 8 wherein said removing step comprises using a biased member closely adjacent to the other of said magnetic brush rollers.

10. The method according to claim 9 wherein said step of developing comprises developing tri-level images comprising charged and discharged area images and background areas intermediate to said image areas and said biased members are biased to a voltage level approximately equal to the voltage level of said background areas.

11. Apparatus for printing toner images, said apparatus comprising:

means for creating latent electrostatic images on a charge retentive surface;

means for developing said latent electrostatic images with developer material containing additives used for enhancing developer performance but which tend to selectively and/or independently deposit on the imaging surface;

means for intercepting said additives prior to said toner images being developed on said imaging surface; and means for returning said intercepted additives back to a supply of said developer material.

12. Apparatus according to claim 11 wherein the means for developing comprises magnetic development rolls, portions of which form a development nip with said imaging surface.

13. Apparatus according to claim 12 wherein said additives comprise zinc stearate.

14. Apparatus according to claim 13 wherein said additives further comprise aerosil.

15. Apparatus according to claim 12 wherein the means for intercepting comprises a biased member supported closely adjacent to one of said magnetic development rolls for attracting said additives thereto prior to their being carried into said nip.

16. Apparatus according to claim 15 wherein said means for returning said additives comprises the means for scraping them from said biased member and permitting them to fall into said supply of developer.

17. Apparatus according to claim 16 wherein said means for developing comprises means for developing tri-level images comprising charged and discharged area images and background areas intermediate to said image areas, and said biased member is biased to a voltage level approximately equal to the voltage level of said background areas.

18. Apparatus according to claim 12 including means for removing additives from said developer material which were not removed during said intercepting step.

19. Apparatus according to claim 18 wherein said means for removing additives comprises a biased member positioned closely adjacent to the other of said magnetic brush rollers.

20. Apparatus according to claim 19 wherein said means for developing comprises the means for developing tri-level images comprising charged and discharged area images and background areas intermediate to said image areas, and said biased members are biased to a voltage level approximately equal to the voltage level of said background areas.

* * * * *